US006189709B1

(12) United States Patent
Cullen

(10) Patent No.: US 6,189,709 B1
(45) Date of Patent: Feb. 20, 2001

(54) RACKS AND HOOKS FOR HANGING WORKPIECES IN INDUSTRIAL COATING SYSTEMS

(75) Inventor: Lawrence E. Cullen, Hayden Lake, ID (US)

(73) Assignee: Mighty Hook, Inc., Chicago, IL (US)

( * ) Notice: Under 35 U.S.C. 154(b), the term of this patent shall be extended for 0 days.

(21) Appl. No.: 09/455,150

(22) Filed: Dec. 6, 1999

Related U.S. Application Data

(60) Provisional application No. 60/122,922, filed on Mar. 5, 1999.

(51) Int. Cl.[7] ..... A47F 5/08
(52) U.S. Cl. ..... 211/118
(58) Field of Search ..... 211/118, 119; 118/500; 204/297

(56) References Cited

U.S. PATENT DOCUMENTS 1,533,805 4/1925 Oliver .
5,147,050 9/1992 Cullen .
5,524,774 6/1996 Cullen .
5,531,334 7/1996 Forby .
5,762,205 * 6/1998 Davitz ..... 211/118
5,897,709 * 4/1999 Torefors ..... 118/500

* cited by examiner

*Primary Examiner*—Alvin Chin-Shue
*Assistant Examiner*—Sarah Purol
(74) *Attorney, Agent, or Firm*—Fitch, Even, Tabin & Flannery

(57) ABSTRACT

A rack for hanging workpieces in industrial coating systems having a horizontal bar or beam with an upper flange, a lower flange, and a web joining those flanges, wherein the upper flange has a hook receiving aperture, and the flow flange has a hook receiving slot. The aperture and the slot are aligned to receive a hook from which a workpiece may be hung. The hook is bent near its upper end to form a spring with a terminal leg and a depending leg. The end of the terminal leg extends into the aperture in the upper flange, and the depending leg extends through the slot in the lower flange, behind a detent. The force of the spring biases the depending leg against release from behind the detent.

6 Claims, 3 Drawing Sheets

RACKS AND HOOKS FOR HANGING WORKPIECES IN INDUSTRIAL COATING SYSTEMS

This application claims the benefit of Provisional No. 60/122,922 filed Mar. 5, 1999.

FIELD OF THE INVENTION

The present invention relates to racks for supporting workpieces in industrial coating operations and, more particularly, to such racks having removable hooks for hanging such workpieces. It finds particular application to industrial electrostatic coating systems.

BACKGROUND OF THE INVENTION

Industrial coating systems employ a conveyor from which workpieces are hung on support racks and are conveyed through several stations, usually including stations for performing the steps of cleaning, rinsing, drying, coating, and baking. In many industrial coating operations, the workpieces travel through an electrostatic coating booth wherein the electrically grounded workpieces are sprayed or coated with electrically charged coating particulates, either liquid or powder. After coating and baking, the coated workpieces are removed from the racks and the racks are reused for another coating cycle. Because of the recycling of the racks, they become coated and encrusted with multiple layers of the coating material. It is important in those instances where electrostatic coating is employed that the support rack be electrically conductive so that workpieces can be maintained in a grounded state. The workpieces are electrically connected to ground through a conductive support rack so that electrically charged particulates are attracted to the workpieces by the electrostatic field. Thus, it is desirable to provide a support rack wherein the electrical contact between individual hooks depending from the rack are maintained in low-resistance electrical contact with the rack so that the workpieces suspended from the hooks will be satisfactorily grounded.

Each coating cycle applies a coating layer to the exposed, workpiece-engaging portion of the support hook, which covers the entire surface of the hook except for the small area of contact with the workpiece. Unless identical workpieces are coated in subsequent cycles, so that the workpiece is in electrical contact with the hook at an identical position, it becomes necessary to clean the support hook to assure the requisite electrical contact between the workpiece and the support hook. Accordingly, it is desirable that the support hooks be detachably engaged with the rack so that coated hooks can be periodically removed and replaced with new or cleaned hooks. Simple and rapid interchangeability of the support hooks is also desirable so that different sizes and shapes of support hooks can be interchanged as desired for the rack to be used for coating a wide variety of workpieces. It is desirable to provide this interchangeability while still maintaining good electrical contact between each support hook and its respective rack during coating operations.

In this connection, it has been found desirable to form a support hook in the shape of a spring to bias a clean surface of the hook against a clean surface of its support rack. An early example of such a cooperative hook and rack construction may be found in U.S. Pat. No. 1,533,805, relating to a rack for electroplating workpieces. A more recent example of such a cooperative hook and rack construction may be found in U.S. Pat. No. 5,531,334, for electrostatically coating workpieces.

Such prior art hook and rack constructions have been found to have certain shortcomings in industrial coating operations, and it is the principal object of the present invention to provide a hook and rack construction having substantially improved performance.

SUMMARY OF THE INVENTION

In accordance with the present invention, there is provided an inexpensive support rack and cooperating hook for supporting workpieces during transport through the various stations of an industrial coating operation. The rack comprises a horizontal bar or beam having an upper flange, a lower flange, and a web joining the flanges. The upper flange has a hook-receiving aperture formed in it, and the lower flange has a hook-receiving slot formed in it extending inwardly from the edge of the flange toward the web and thence outwardly toward the edge to thereby provide a detent. The opening and the slot are aligned to receive a hook from which a workpiece may be hung. The hook is bent near its upper end to form a spring having a terminal leg and a depending body leg. The end of the terminal leg extends into the aperture in the upper flange, and the depending leg extends through the slot formed in the lower flange behind the detent. The spring formed from the hook biases the depending leg against release from behind the detent.

The bar and hook in combination provide means by which the hook may quickly be installed in the bar, with spring bias enhancing the conductivity of the junction between the bar and the hook, and the hook is easily removed from the bar for substituting a different hook or installing the same hook after the hook has been cleaned. An important feature of the present invention is the provision of a horizontal bar or beam of increased stiffness, which resists bending along either the x-axis or y-axis of its cross-section. Prior art horizontal bars, such as those disclosed in the patents cited above, while providing acceptable stiffness along the y-axis, have provided inferior stiffness against bending along the x-axis.

BRIEF DESCRIPTION OF THE DRAWINGS

In the drawings, wherein like elements are referred to alike.

DETAILED DESCRIPTION OF THE PREFERRED EMBODIMENTS

Figure 1:
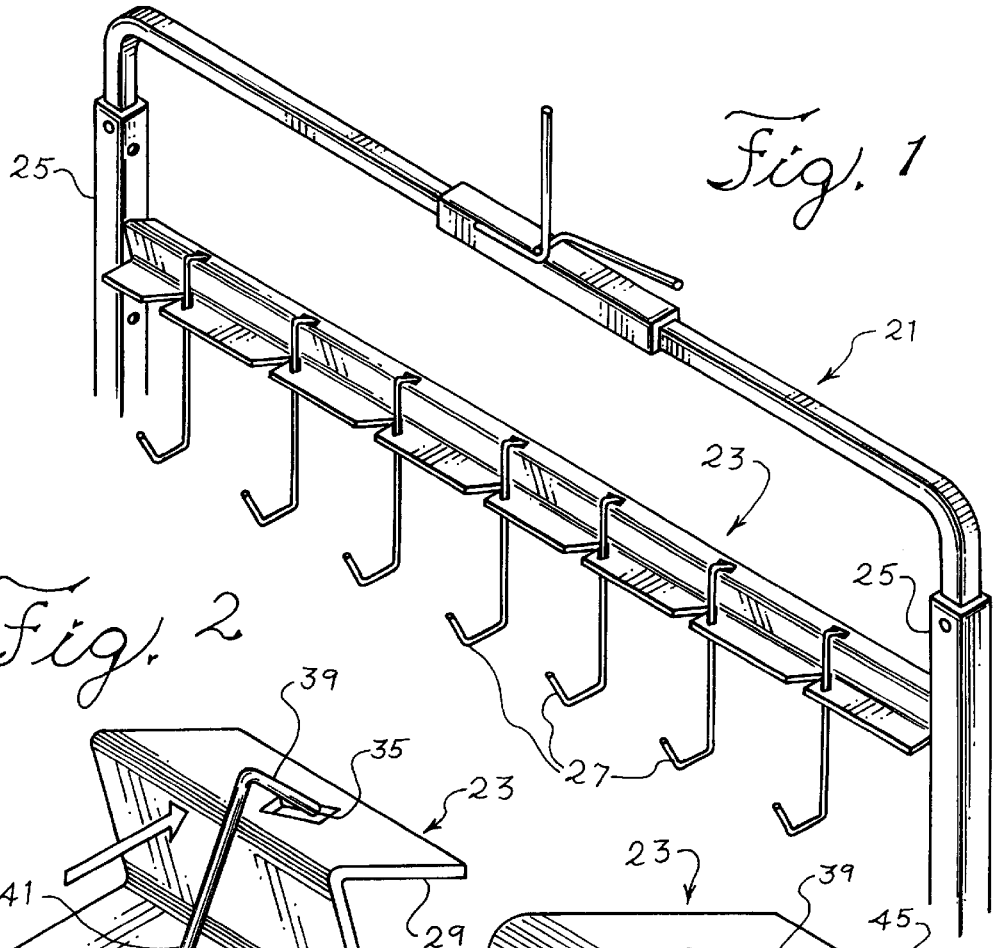
FIG. 1 is a fragmentary perspective view of a rack with a horizontal bar and support hooks embodying various features of the present invention.

Shown in FIG. 1 is a rack embodying various features of the present invention, referred to generally by the reference numeral 21. The rack 21 is designed to be supported from a chain conveyor in the manner shown in my U.S. Pat. Nos.

5,147,050 and 5,524,774, the disclosures of which are hereby incorporated by reference. The rack includes a generally horizontal bar or beam 23 suitably attached to vertical members of the rack 25. Releasably secured to the bar 23 are a plurality of hooks 27 from which workpieces may be hung as the conveyor conducts the rack through various stations of a coating operation.

Figure 2:
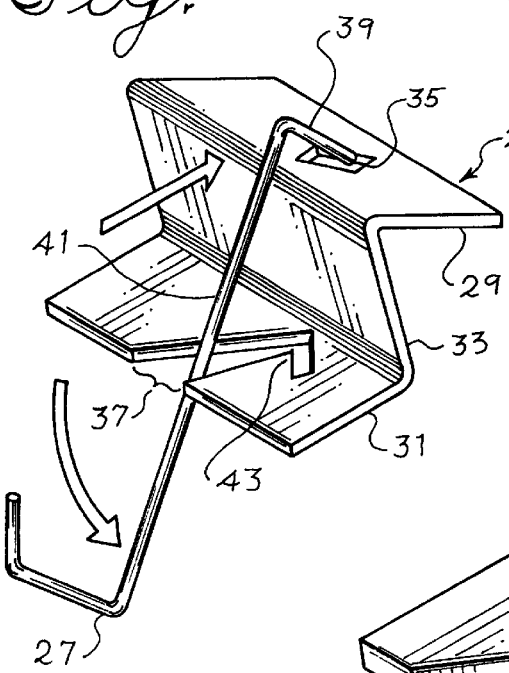
FIG. 2 is an enlarged fragmentary view of the horizontal bar and a single support hook of FIG. 1, illustrating the manner of insertion of the hook into the bar.

As shown more particularly in FIG. 2, the bar 23 has three beam elements, an upper flange 29, and a lower flange 31 and a web 33 joining said flanges. The beam has a generally S- or Z-shaped cross section, with the upper flange 29 having an aperture 35 formed therein, and the lower flange 31 having a slot 37 formed therein. The hook 27 is bent near its upper end to provide a terminal leg 39 and a depending leg 41.

The slot 37 extends inwardly from the edge of the lower flange 31 toward the web 33, and thence outwardly toward the same edge to provide a detent 43.

The hook 27 is shown in FIG. 2 in its unrestrained position, before it is inserted into the hook receiving aperture 35 and the hook receiving slot 37. To detachably secure the hook 27 in the bar 23, the terminal leg 39 of the hook is first inserted into the aperture 35, in the direction shown by the broad arrow in FIG. 2, and the depending leg 41 is then forced into the slot 37 until it clears the detent 43, and is retained behind the detent.

It will be seen that the aperture 35 is diamond shaped with one vee of the diamond pointing toward the edge of the upper flange element 29. The aperture is preferably formed by punching through the steel flange with a diamond-shaped punch leaving relatively sharp edges around its periphery. These sharp edges enhance the conductivity of the junction between the terminal leg 39 of the hook and the edge of the aperture 35.

Similarly, the terminus of the slot 43 is formed in a general diamond shape with one vee of the diamond pointing through the edge of the lower flange, so that the depending leg 41 of the hook is also in enhanced conductive relationship with the lower flange 31.

It will be understood that when the depending leg of the hook 27 is urged into position behind the detent 43, there is a spring bias urging that leg against the vee of the slot 37, and also urging the terminal leg 39 against the vee of the aperture 35. This bias may readily be overcome by manual pressure, releasing the depending leg 41 from behind the detent and allowing the hook to readily be removed.

An advantage of the vee-shape of the bearing surfaces of the aperture 35 and the slot 37 is that it permits the use of hooks made of various gauges of wire to be received securely therein. The tapering width of the vee accommodates hooks formed of wire of substantially smaller diameter than the breadth of the aperture 35 or the slot 37, while maintaining the desired enhanced conductive relationship between the hook and the bar.

The bar or beam 23 advantageously is made from flat steel stock, which is punched to form the apertures 35 and slots 43 while the stock is in its flat state. The punched flat stock is then bent or folded to provide the upper and lower flanges 29 and 31, respectively.

Figure 3:
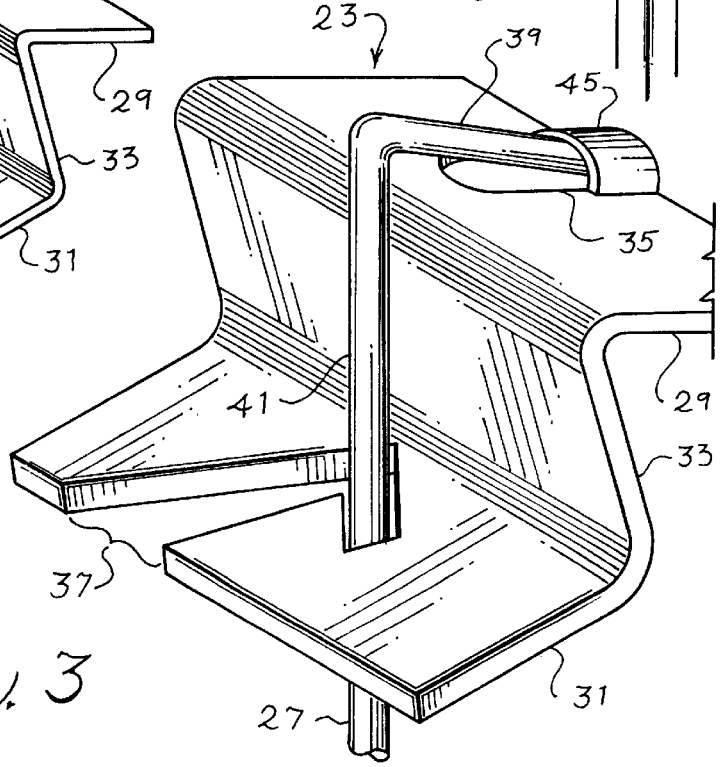
FIG. 3 is an enlarged fragmentary view of an alternative embodiment of the bar of the present invention.

Illustrated in FIG. 3 is an alternative embodiment of the bar and hook of FIG. 1, in which the aperture 35 is bridged at the edge of the flange by a semi-cylindrical retainer 45. The hook is inserted into the aperture and under the retainer, which functions to restrain the terminal leg of the hook against movement. Although this construction may be advantageous in some situations, it is less preferred than the embodiment of the aperture shown in FIG. 2.

Figure 4:
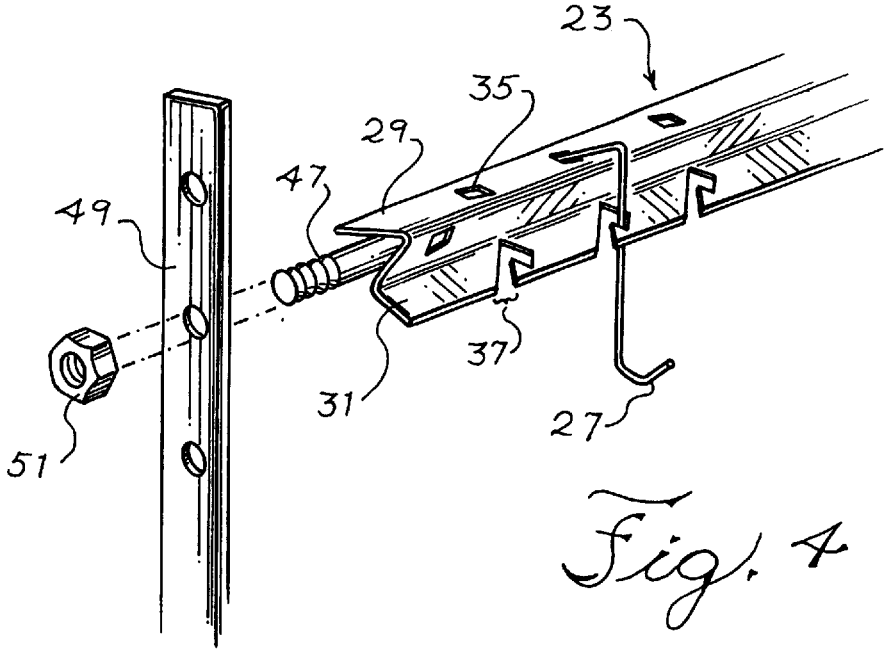
FIG. 4 is a fragmentary perspective view of the bar and support hook shown in FIG. 1, illustrating its attachment to a vertical rack member.

FIG. 4 discloses means by which the bar or beam 23 may be attached to a vertical member 49 of a rack. A threaded rod 47 is welded or otherwise secured to the bar 23, and extends through an opening in the member 49. The rod 47 is secured by a nut 51.

Figure 5:
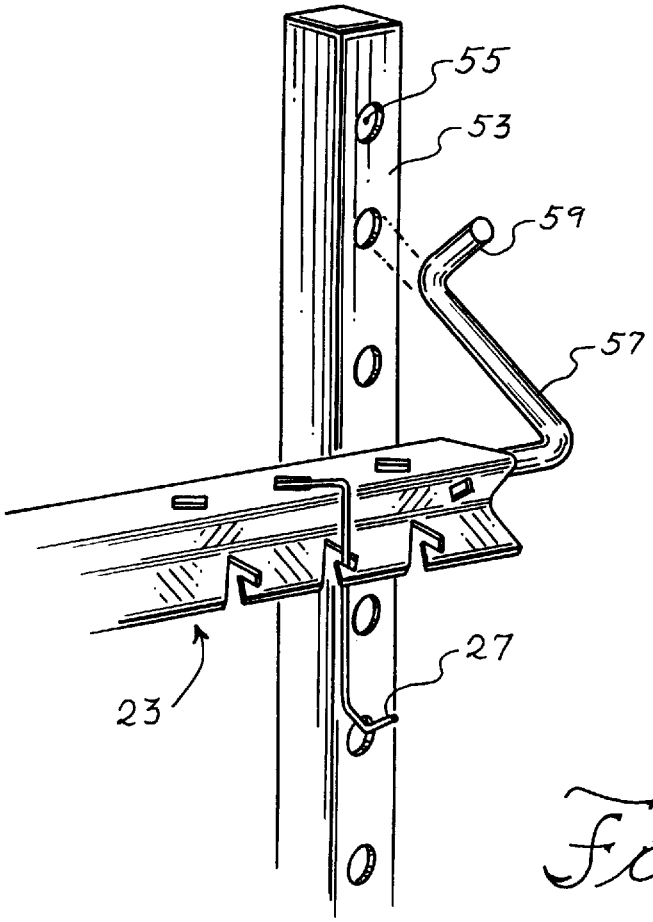
FIG. 5 is a fragmentary view of the bar and hook of FIG. 1, showing an alternative means of attachment to a vertical rack member.

FIG. 5 shows another alternative means of attaching the bar 23 to a vertical member of the rack. The vertical member 53 is a tubular member of rectangular cross section and includes a plurality of openings 55. An arm 57 is welded or otherwise secured to the end of the bar 23, with an upturned elbow 59, the diameter of which is sized to be received snugly with an opening 55. The bar 23 is secured by inserting the elbow 59 into an opening 55, and locking the elbow on the inside of the tubular member 53, against its inside surface. A similar means of attachment is disclosed in my U.S. Pat. No. 5,524,774, cited above.

Figure 6:
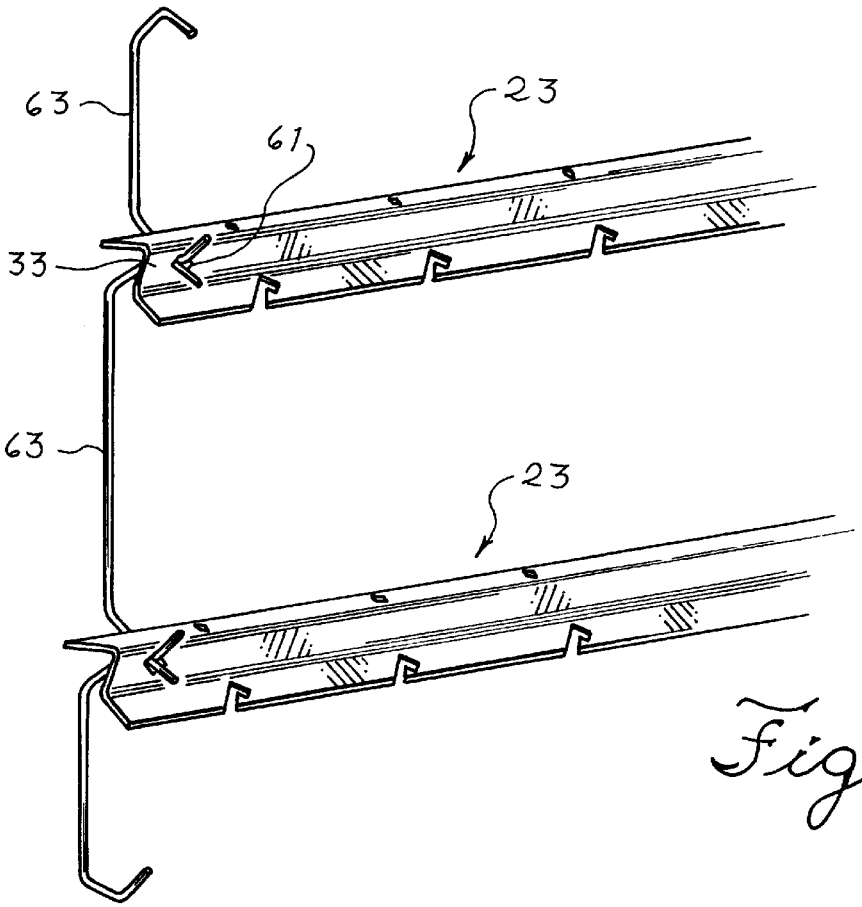
FIG. 6 is a fragmentary perspective view of the bar of FIG. 1 showing an alternative means of supporting the bar.

FIG. 6 illustrates yet another means for suspending a plurality of bars 23, one above the other. An aperture 61 is provided near the end of the bar 23 in the web 33 of the bar. Two C-hooks 63 are inserted through the aperture 63, extending above and below the bar 23, for hanging a plurality of bars 23.

Figure 7:
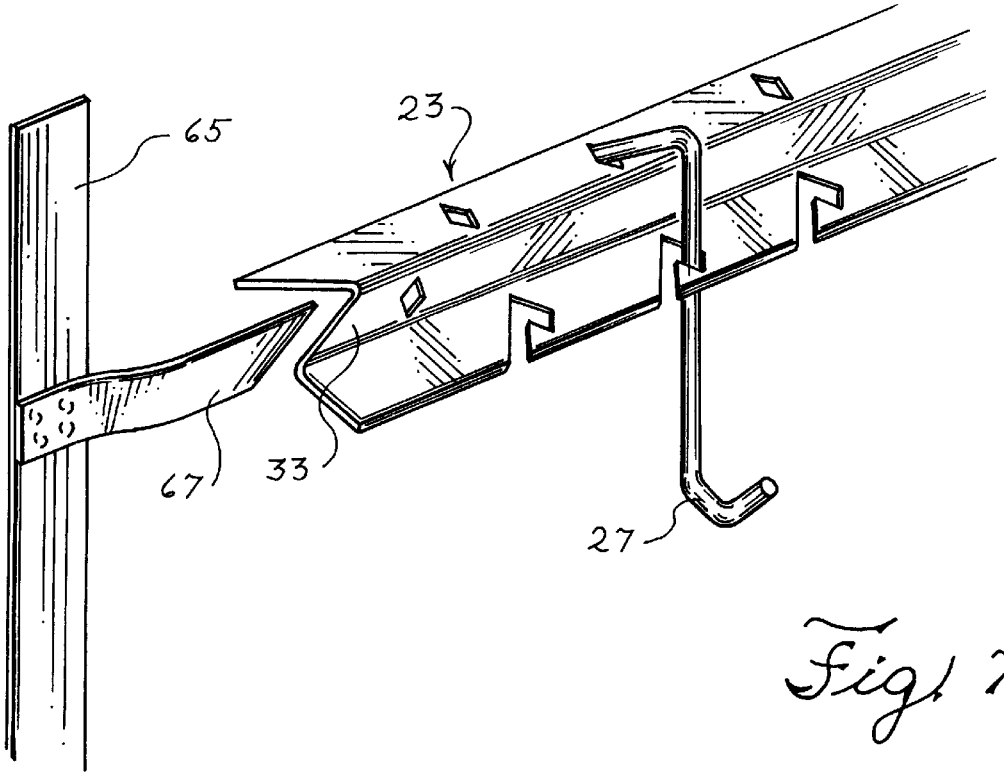
FIG. 7 is a fragmentary perspective view of the bar and hook of FIG. 1, showing yet another alternative means of attachment to a vertical member of the rack.

FIG. 7 discloses yet another means for attaching the bar or beam 23 to a vertical member 65 of a rack. A bracket 67 is secured to the member 65 by riveting, spot welding, or the like, bent so as to be parallel to the web 33 of the bar 23. The bracket 67 may be spot welded to the web 33 to provide its support.

Although the bar or beam 23 has been described as having an S- or Z-shaped cross section, it should be understood that the principles of the present invention may also be enjoyed with beams of various cross sections. For example, a beam having a channel cross section, with upper and lower flanges extending from the web in the same direction instead of in opposite directions, may also be employed, with apertures and slots formed in the upper and lower flanges, respectively. Other beam cross sections will be apparent to one skilled in the art in light of the foregoing description and drawing.

Further in this connection, while the invention has been described with reference to a preferred embodiment and alternative embodiments, it will be understood to those skilled in the art, that various changes may be made and equivalents may be substituted for elements thereof without departing from the scope of the invention. In addition, many other modifications may be made to adapt a particular workpiece or material to the teachings of the invention without departing from the essential scope of the invention. It is therefore intended that the invention not be limited to the particular embodiments disclosed as the best mode in carrying out this invention, but that the invention be construed to include all embodiments falling within the scope of the following claims.

What is claimed is:

1. A rack adapted for hanging workpieces in industrial coating operations comprising:

a horizontal beam having an upper flange, a lower flange, and a web joining said flanges, said upper flange having a hook-receiving aperture formed therein, said lower flange element having a hook-receiving slot formed therein extending inwardly from the edge of said flange toward said web and thence outwardly toward said edge to thereby provide a detent, said aperture and said slot being aligned to receive a hook from which a workpiece may be hung, said hook being bent near its upper end to form a spring having a terminal leg and a depending leg, the end of said terminal leg extending into the aperture formed in said upper flange and said depending leg extending through said slot formed in said lower flange behind said detent, the force of said spring biasing said depending leg against release from behind said detent.

2. The rack of claim 1 wherein the horizontal beam has a generally Z-shaped cross section.

3. The rack of claim 1 wherein the horizontal beam has a channel cross section.

4. The rack of claim 2 wherein said aperture is diamond-shaped, with a vee of the diamond pointed toward the edge of the upper flange.

5. The rack of claim 2 wherein the blind end of said slot forms a vee pointed toward the edge of said lower flange.

6. A method of forming the beam of claim 1 comprising the steps of providing a flat sheet steel strip of predetermined width, punching a plurality of said apertures at preselected locations along one edge of the strip, punching a plurality of said slots at predetermined locations corresponding to the locations of said apertures along the other side of said strip, and folding said strip along two longitudinal axes to form said upper flange and said lower flange.

* * * * *